US005725696A

United States Patent [19]

Maresch et al.

[11] Patent Number: 5,725,696

[45] Date of Patent: Mar. 10, 1998

[54] PROCESS AND PLANT FOR PRODUCTION OF RAW STAINLESS STEEL CASTINGS

[75] Inventors: Gerald Maresch, Modling, Austria; Edgar Braun, Upper St. Clair, Pa.

[73] Assignee: Andritz-Patentverwaltungs-Gesselschaft m.b.H., Graz, Austria

[21] Appl. No.: 581,567

[22] PCT Filed: Jul. 6, 1994

[86] PCT No.: PCT/EP94/02215

§ 371 Date: Apr. 8, 1996

§ 102(e) Date: Apr. 8, 1996

[87] PCT Pub. No.: WO95/02706

PCT Pub. Date: Jan. 26, 1995

[30] Foreign Application Priority Data

Jul. 13, 1993 [AT] Austria ..... 1375/93

[51] Int. Cl.[6] ..... C21D 8/02; C21D 9/60; C21D 9/573

[52] U.S. Cl. ..... 148/601; 148/542; 148/602; 148/625; 72/39; 72/41

[58] Field of Search ..... 148/542, 601, 148/602, 625; 72/39, 41

[56] References Cited

U.S. PATENT DOCUMENTS

| | | | |
|---|---|---|---|
| 5,003,804 | 4/1991 | Kenmochi et al. | 72/39 |
| 5,279,141 | 1/1994 | Kenmochi et al. | 72/39 |
| 5,292,374 | 3/1994 | Maresch et al. | 134/3 |

FOREIGN PATENT DOCUMENTS

| | | |
|---|---|---|
| 0 292 313 A2 | 11/1988 | European Pat. Off. . |
| 0 369 984 A1 | 5/1990 | European Pat. Off. . |
| 0 387 555 A1 | 9/1990 | European Pat. Off. . |
| 0 453 321 A1 | 10/1991 | European Pat. Off. . |
| 1333943 | 10/1973 | United Kingdom . |

OTHER PUBLICATIONS

International Search Report for PCT/EP94/02215, dated Jul. 12, 1994.

Patent Abstracts of Japan, vol. 14, No. 159 (M956), for publication JP A, 02 020 610, dated Jan. 24, 1990.

*Primary Examiner*—Deborah Yee

*Attorney, Agent, or Firm*—Alix, Yale & Ristas, LLP

[57] ABSTRACT

The invention refers to a process for production of raw stainless steel castings, in particular for stainless steel strip, covering rolling and annealing of cast material if required, as well as de-scaling, in particular by pickling in aqueous media, and coiling for raw stainless steel strip if necessary. In order to achieve greater flexibility as regards steel grades that can be treated and dimensions of the castings, the material is to be heat-treated in batches and preferably also annealed, cooled and de-scaled immediately after the final heat treatment stage, without intermediate storage, in batches. In a process covering the process stages for casting, rolling of the cast material if necessary, cooling, as well as de-scaling, in particular by pickling in aqueous media, and coiling, if necessary, to form raw stainless steel coils, the material is to be cast in batches and de-scaled immediately afterwards without intermediate storage in order to obtain the same advantage. The invention also covers equipment to carry out the process described.

32 Claims, 8 Drawing Sheets

Conventional Technology

Variant 1 according to the invention

Variant 2 according to the invention

Variant 3 according to the invention

PROCESS AND PLANT FOR PRODUCTION OF RAW STAINLESS STEEL CASTINGS

The invention relates to a process for the production of stainless steel strip or plates, in which the cast material is annealed and cooled in batches, and to a process covering casting and cooling in batches.

In the processes already known for production of stainless steel, in particular for stainless steel strip or plate, the stainless steel is melted with all alloying elements and the melting charge cast to a slab, the surface of which is cleaned mechanically to remove any impurities after cooling. After this the cleaned slab is heated again and fed to a hot rolling mill, where it is rolled out to a strip—typically with a thickness of not more than 15 mm, and measuring 2.5 m wide maximum and up to 100 m long or more—or rolled to a plate—typically with a thickness between 10 and 150 mm and measuring approximately 10 m in length and 3 m in width. Hereinafter, the term "strip" will be used in a generic sense to include both thin strip, i.e., up to about 15 mm in thickness, and plate, i.e., with a thickness up to 150 mm or greater. If the hot rolling mill is a Steckel mill, the stainless steel strip can be treated in batches in a suitable pickling line, as described, for example, in AT-PS 394 734, without requiring any further annealing. Here it is possible to treat different grades of steel and strip or plates of different dimensions immediately after one another without requiring any complicated change-over work.

If there is no Steckel mill, the hot stainless steel strip is annealed in continuous operation on annealing and pickling lines in a gas-heated annealing furnace, then cooled and most of the scale removed mechanically, the rest being removed by pickling, preferably using acids, with the possibility of saving acids by pre-treating with electricity in neutral salt solutions. In this type of plant the stainless steel strips are welded to form an endless strip which is separated again at the end of the line. Plates or other shapes of raw casting are conveyed through the plant in different ways. Apart from the high investment costs for the welding machine, conveying equipment and other devices required in connection with this, this means of production also has the disadvantage that the strip has to be taken from a looper during the welding time and the looper then has to be replenished. In addition, if there is a fault at the welding machine or looper, all of the strip that is in the annealing furnace when the fault occurs has to be scrapped because it is annealed for too long.

More recently, more and more raw stainless steel castings have been cast in the form of plates, then de-scaled after cooling and, preferably, pickled. These plates do not always have to be annealed, however in some cases annealing may be required. If so, the plates also have to go through the subsequent or each subsequent treatment plant if they are to be de-scaled and pickled, and possibly also be annealed before reaching these treatment stages.

The invention is intended to avoid the above mentioned disadvantages and to provide a process and a plant in which there is greater flexibility in the sequence of stainless steel grades and dimensions of the stainless steel strip or plates in the entire production process for raw stainless steel castings.

According to the invention, this is achieved in the variant with rolled raw castings by heat treatment of the material in batches, without any intermediate storage, where the material is pushed through a heat treatment system such as an annealing furnace if necessary and through the de-scaling system, preferably a pickling plant, until the leading end of the material comes out of the de-scaling plant, after which the material is pulled exclusively or additionally through the annealing furnace and the de-scaling plant by devices located after the de-scaling plant. Thus, no equipment is required to thread the material in and pull it through, and the batch production and treatment of stainless steel strip and/or plates of different qualities and dimensions are thus greatly simplified. Furthermore, the method of annealing and de-scaling in batches without intermediate storage dispenses with the need to weld together the stainless steel strips and any plates cut from the strip and then separate them again, and the overall production process thus becomes much simpler and also a great deal more flexible than conventional processes. The plant designed to carry out the process can be built without welding and separating machines and without a looper, thus making it smaller, simpler and cheaper, while providing greater flexibility in its application.

The process variant for production of cast stainless strip or plates is characterised in the invention by casting in batches and de-scaling immediately after this without any intermediate storage, where the material is pushed through an annealing furnace if necessary and through the de-scaling plant, preferably a pickling plant, until the leading end of the material comes out of the de-scaling plant, after which the material is pulled exclusively or additionally through the annealing furnace and the de-scaling plant by devices located after the de-scaling plant. The advantages here as regards flexibility in producing different grades of stainless steel and castings with different dimensions immediately after one another are the same as for the first process described above.

If, according to a further embodiment of the invention, the material is hot.-rolled first of all after casting, then annealed, cooled and then de-scaled without intermediate storage of the annealed material after the last heat treatment stage, a better quality of stainless steel can be obtained with many materials, while still retaining the above mentioned advantages. In the production of, for example, stainless steel strip, the strip can be hot-rolled after casting and then annealed, cooled and de-scaled immediately after rolling. If the stainless steel is cast to form a strip directly from the melting charge and then rolled if necessary to the desired thickness on a hot rolling mill, the scale that has formed can be removed directly in a de-scaling plant after the strip has cooled. The de-scaling plant comprises an initial mechanical de-scaling stage followed by a chemical de-scaling process (pickle). In this de-scaling plant the strip need not be rolled into a coil first of all since each step of the process follows on from the previous step in a continuous process. The leading end of the discrete strip, which is not the same width as the rest of the strip following it if the strip has been cast, is not cut off and fed to the scrap until the strip is rolled into a coil or fed directly to the annealing and de-scaling plant, as the case may be. Similarly, the strip tail, which also is not as wide as the rest of the strip, is cut off and recycled to the scrap.

In a preferred design, strip material is fed to a coiling device, preferably a recoiler, and coiled there, the material then preferably being pulled through the plant directly by the recoiler.

In a preferred design, strip material is fed to a coiling device, preferably a recoiler, and coiled there, the material then preferably being pulled through the plant directly by the recoiler.

According to one variant of the invention, the material is cut into plates after leaving the de-scaling plant.

The customer's requirements as regards the dimensions and the surface quality of the stainless steel can be fulfilled in a favourable manner if the strip material is smoothed, for example in a skin-pass mill, before coiling.

In an advantageous further development of the process according to the invention, de-scaling is conducted in a chemical process, following mechanical de-scaling if necessary and preferably by using acids, for example nitric acid, sulphuric acid, hydrochloric acid, hydrofluoric acid, or a mixture of at least two of these acids and/or aqueous solutions of one or more salts of these acids with the metals contained in the material. This permits de-scaling in the tried and tested process, in which particularly good surface qualities are obtainable.

It is of advantage to the chemical de-scaling process described above if the material undergoes electrolytic treatment, particularly in a neutral salt solution, before chemical de-scaling, preferably with the material having alternately anodic and cathodic poling. The preceding electrolytic treatment causes a loosening of the scale layer and thus enhances the effectiveness of the chemicals in the pickling liquid.

In order to meet the speed requirements better when moving the material through the de-scaling plant, a further feature of the invention is to heat the material inductively in the annealing furnace. Thus, the heating times for the material can be reduced to approximately 10 to 20% of the time required in conventional annealing furnaces using gas heaters and as a result, this will also shorten the processing time through the annealing plant and the throughput through the entire plant may be increased.

A plant according to the invention for production of raw stainless steel castings, particularly of stainless steel strip, comprises in a first variant a casting line for the raw material and a de-scaling plant, preferably pickling plant, and is characterised according to the invention by cooling devices for the cast material, as well as equipment for pushing the leading end of the material through the de-scaling plant that follows immediately after. Thus, there is no need for any type of equipment to joint the consecutive batches, no looper and also no separating plant after the de-scaling plant, thus the investment costs can be drastically reduced for the plant, which also takes up less space. In addition, the equipment described avoids creating the amount of scrap otherwise produced if there is a fault at the welding machine or looper because these expensive and sensitive plant components are not required.

The advantages mentioned above also come to the fore in the variant of the plant according to the invention comprising a rolling mill, preferably a hot rolling mill, and a de-scaling plant, preferably a pickling plant, which plant is characterised in that the de-scaling plant follows directly after an annealing device for the rolled material, preferably an annealing furnace, and a cooling device after the annealing unit if required, without intermediate storage, for example on recoiling and decoiling equipment.

An advantageous design of the plant according to the invention is characterised in that the annealing device is constructed as an inductive annealing unit. Due to the shorter heating times, it is possible to use considerably smaller annealing furnaces while still achieving the same throughput, which leads to large savings in investment costs, or a higher throughput is obtained for the furnace and thus, for the entire plant if the furnace dimensioning is retained at the same size. In addition, the operating costs can also be reduced as a result of direct heating and the resulting drop in heat losses.

In a preferred design the annealing device and the de-scaling plant are fitted with devices to push the leading end of the material through the devices and the plant, i.e. a design as push-type annealing and pickling plant. With this design it is possible to produce different grades and sizes of raw stainless steel castings, in particular strip and the plates then made from the strip, in a favourable manner and without generating a great deal of scrap.

It is of advantage here to include devices after the de-scaling plant to grip the leading end of the material coming out of the de-scaling plant and these devices should preferably be driven winding equipment, such as a recoiler.

In the same way, a variant of the invention could also include transverse shears after the de-scaling plant.

In order to meet the requirements regarding dimensions and surface quality of the strip and plates to optimum advantage, a further characteristic of the invention includes a device to smooth the material, preferably a strip smoothing device such as a skin pass mill, between the de-scaling plant and the recoiler and/or the transverse shears.

A preferred design of the invention includes at least one chemical de-scaling section in the de-scaling plant, in particular a pickling section with at least one tank for aqueous pickling media, preferably acids, in order to obtain the best stainless steel surface quality using tried and tested technology.

In order to enhance the effect of chemical pickling and thus, either reduce the pickling time or obtain a higher throughput, a further feature of the invention is to include electrodes of different polarity in at least one tank.

To increase the de-scaling effect of the chemicals, at least one washing and brushing machine, preferably with abrasive brushes, can be included between at least two tanks.

In a further design of the plant according to the invention, a rinsing section, preferably containing a washing and brushing machine, preferably with abrasive brushes, is included after the de-scaling plant, in particular a pickling section.

BRIEF DESCRIPTION OF DRAWINGS

In the following description the invention is described in more detail and with references to the enclosed drawing(s).

FIG. 1 shows the sequence of a conventional process for production of stainless steel strip with the consecutive steps to melt the stainless steel, cast the slabs, cool the cast slabs and clean the scale from them, heat them up again, hot-roll them to the required final strip thickness, then cool and wind the strip into a coil. Subsequently, however, after any desired storage period, the coil can be annealed again in a conventional, continuous annealing and pickling plant, then de-scaled mechanically and/or chemically before going on for further processing, the finished strip either being wound into a coil or cut into plates.

Figure 1:
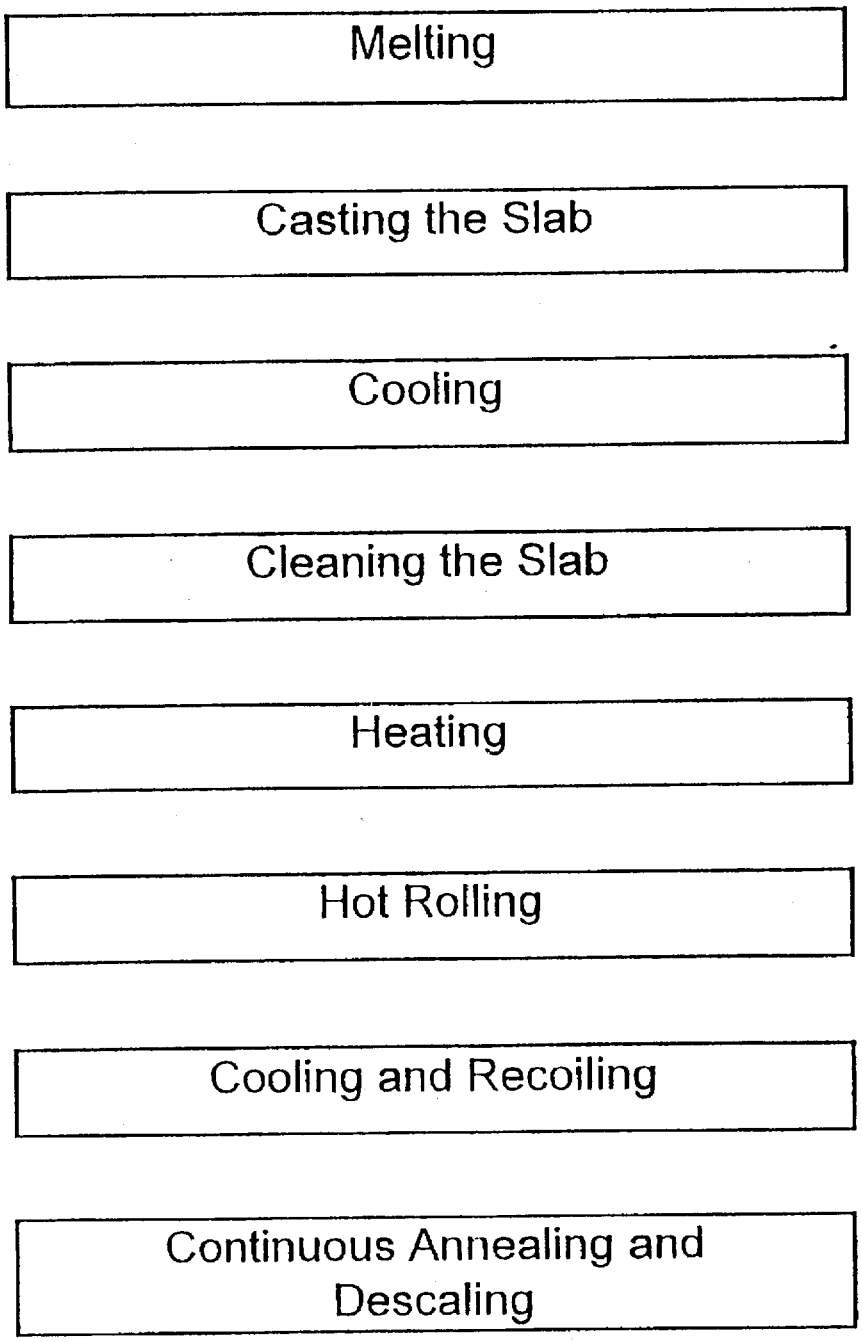
FIG. 1 shows a flow sheet of a conventional process for the production of stainless steel strip, and FIGS. 2, 3 and 4 contain flow sheets of three variants of the process according to the invention.
Figure 2:
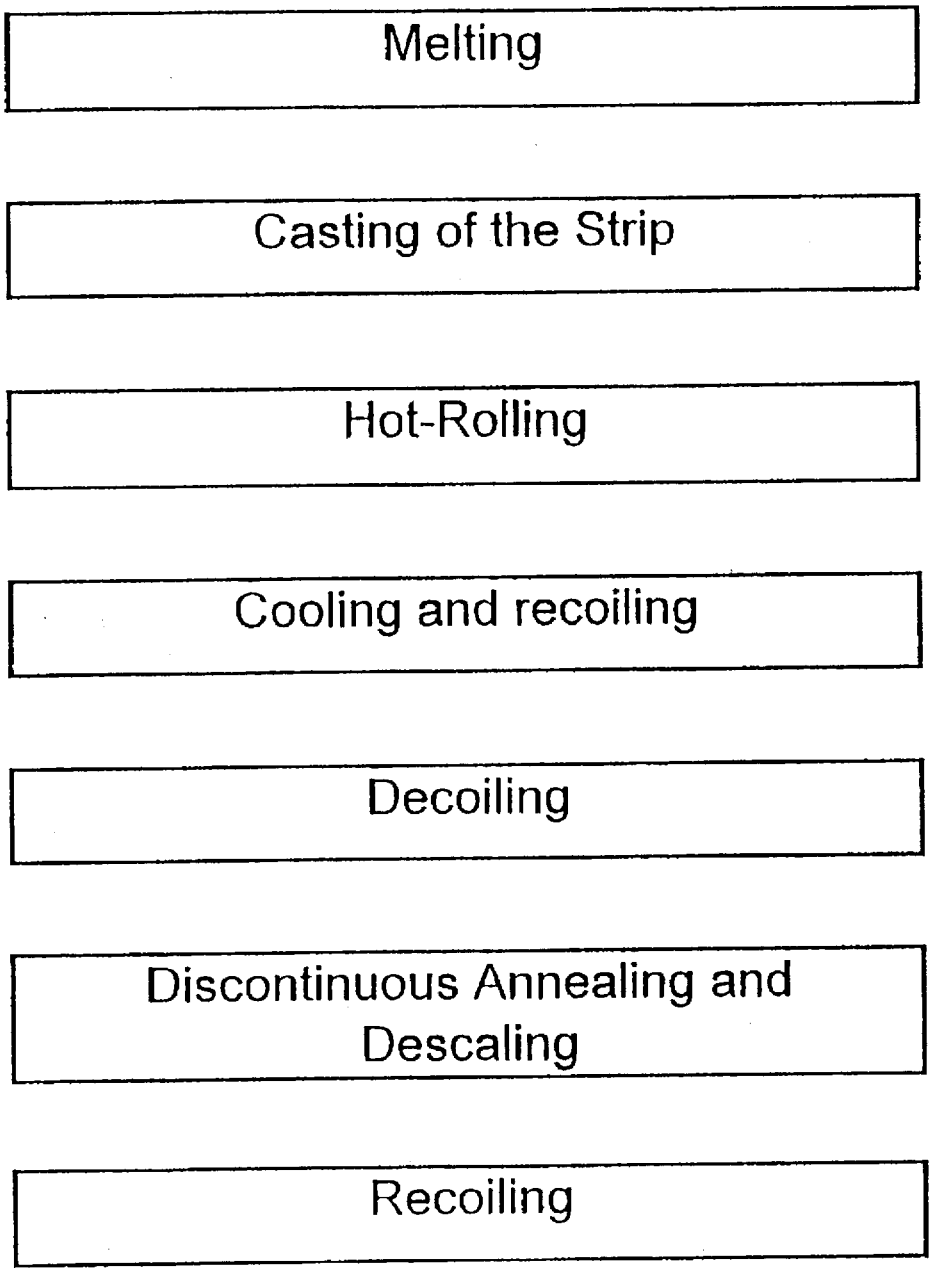

According to a first advantageous variant of the process whose sequence is illustrated in FIG. 2, the stainless steel is first melted, then cast and hot-rolled to the desired strip thickness. Subsequently, the strip is cooled and wound into a coil. After a certain storage period if necessary, the coil is annealed and de-scaled in batch operation, i.e. without being joined to another coil by, for example, welding, after which the finished strip is then recoiled or cut into plates.

Figure 3:
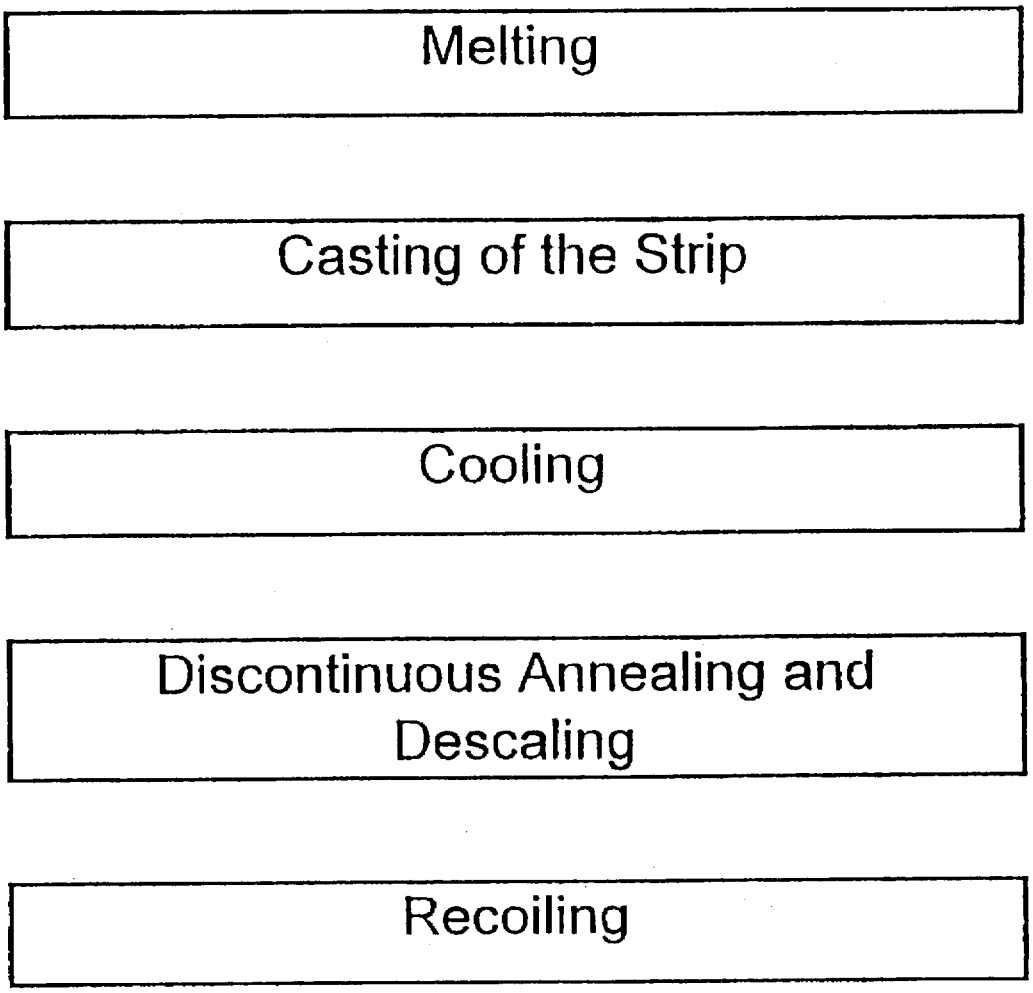

If the strip is cast right away to the desired thickness, as is the case in a second variant of the process illustrated in FIG. 3, the strip, which already has its final thickness, is annealed and de-scaled discontinuously immediately after being cooled. Finally, the strip can either be coiled again or cut into plates.

Figure 4:
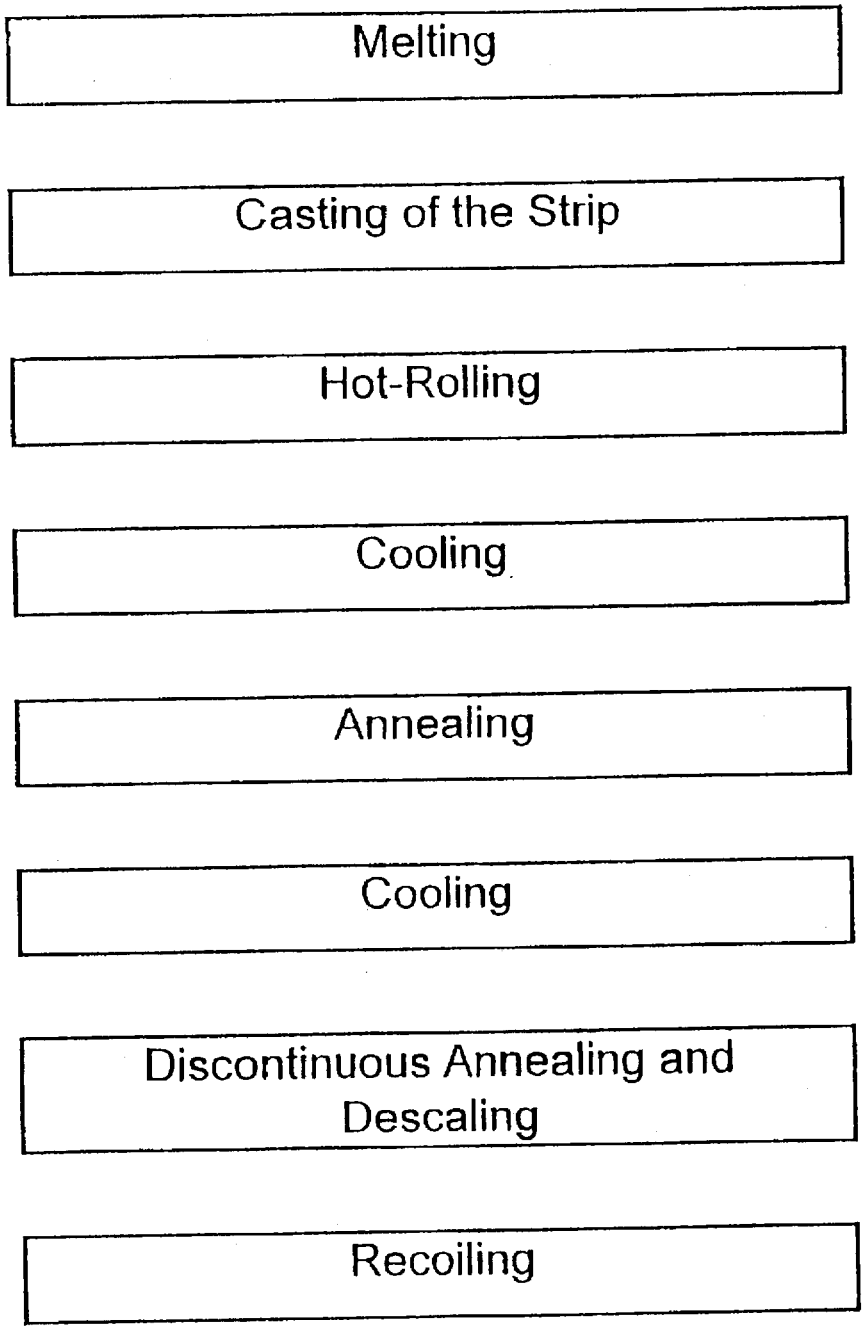

The process sequence illustrated schematically in FIG. 4 completes the process described above in that the strip can be annealed if necessary after hot-rolling and subsequent cooling. Further annealing, immediately followed by de-scaling of the strip in batch operation, then coiling or cutting, cannot take place until the strip has cooled again.

Figure 5:
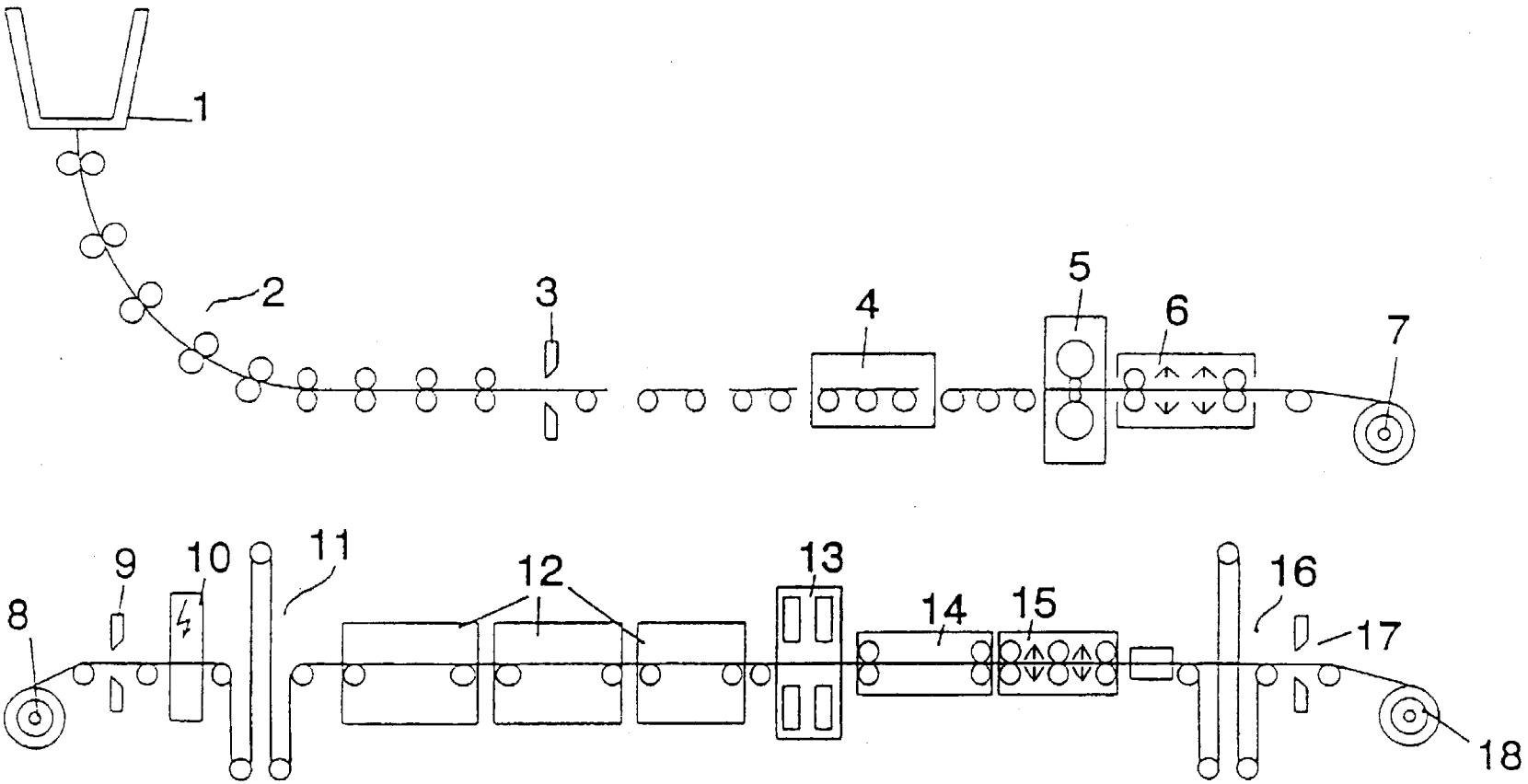
FIG. 5 provides a schematic drawing of a conventional plant for the production of stainless steel strip, and FIGS. 6, 7 and 8, which are also schematic drawings, illustrate advantageous designs for plants to implement the process according to the invention.

FIG. 5 contains a schematic diagram of a plant for production of stainless steel strip according to the conventional process. The stainless steel is melted in the ladle 1 and cast in the continuous casting plant 2. A cutting device 3 cuts sections of a pre-set length, defining discrete strips which are then fed to an annealing furnace 4, then rolled to the desired final strip thickness on a hot-rolling mill 5, cooled in a cooling plant 6 by spraying on water, for example, or by air cooling, and finally wound into coils, preferably on a recoiler 7.

Stainless steel strip coils of this type are then fed to a continuous annealing and pickling plant one after the other. In this connection continuous means that the strips supplied one after the other are unwound by a decoiler 8, joined to one another in a welding plant 10, then pulled through the subsequent plants as a "continuous strip". If the leading strip is to pass through the plant unhindered and without interruption while two strips are being welded together, the strip must be taken from a looper 11 for the welding time. A further annealing stage in the annealing plant 12 can often be dropped, however initial mechanical de-scaling in the de-scaling plant 13, for example, a shot blaster, and chemical de-scaling in the pickling section 14, assisted by electric current if necessary, are absolutely necessary to achieve the required strip surface quality. After passing through a rinsing plant 15 to remove the pickling liquor still on the strip, the strip then goes on to another looper 16 so that it does not hamper cutting operations into individual strip sections on the transverse shears 17. Finally, the strip is wound into a coil on the recoiler 18.

Figure 6:
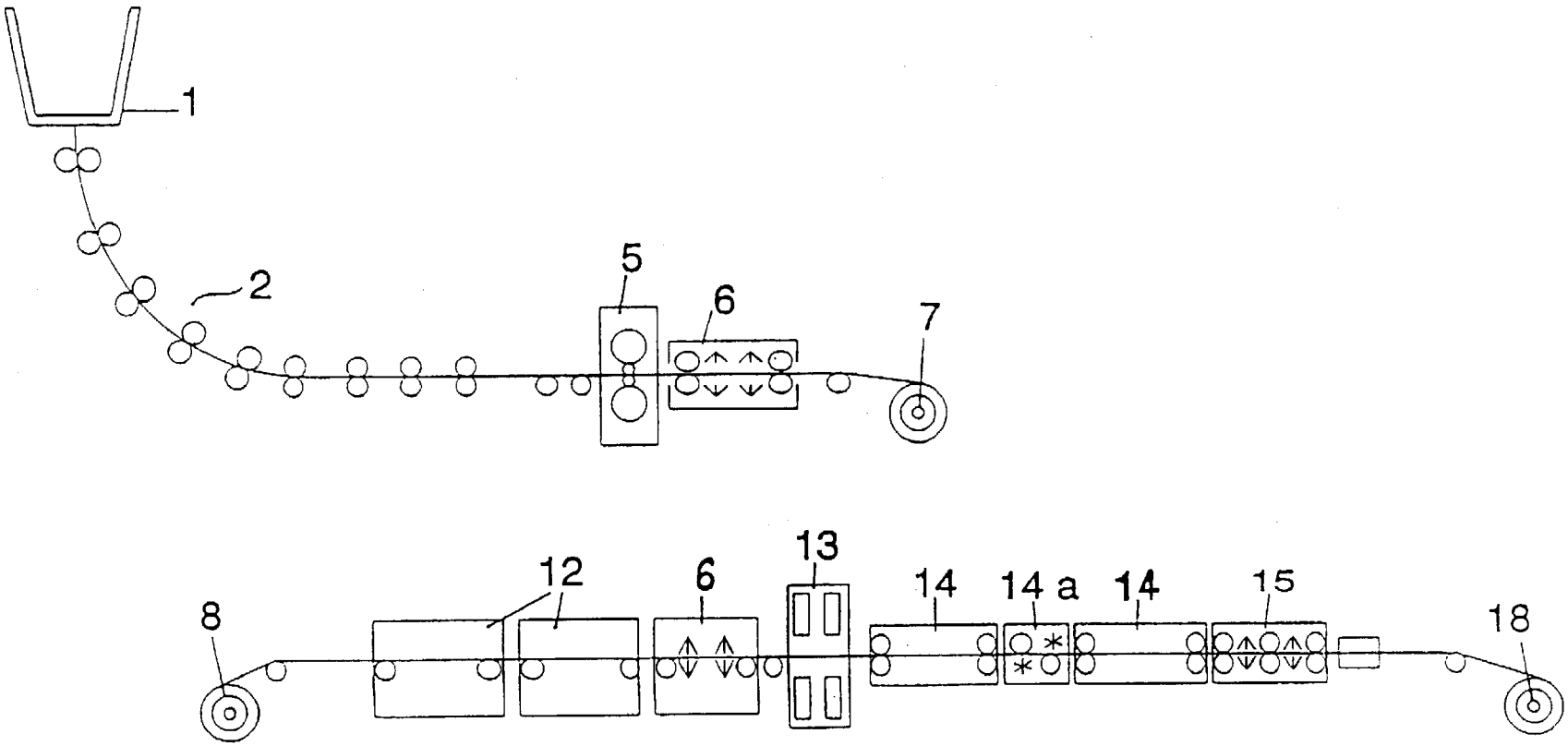

The design variant of the plant according to the invention illustrated in FIG. 6 also shows the ladle 1 and the continuous casting plant 2, however the castings go from here directly to the hot-rolling mill 5, are then cooled in the cooling plant 6 and wound as a discrete strip on a recoiler 7.

Each coil is unwound on the decoiler 8 and fed directly to an annealing furnace 12 without being joined to the preceding or following coil. The leading end of each strip is pushed through the annealing furnace 12, the mechanical de-scaling plant 13 immediately following, the chemical de-scaling plant 14 and the rinsing plant 15 until it reaches the recoiler 18. Here the leading end of the strip is preferably held in a clamp, can then be transported through plants 12, 13, 14 and 15, and is then coiled again.

It is of advantage to have a washing and brushing machine **14*a* between every two pickling tanks in the pickling plant 14, and a set of transverse shears could also be provided in place of the recoiler 18** to cut the finished strip into plates.

Figure 7:
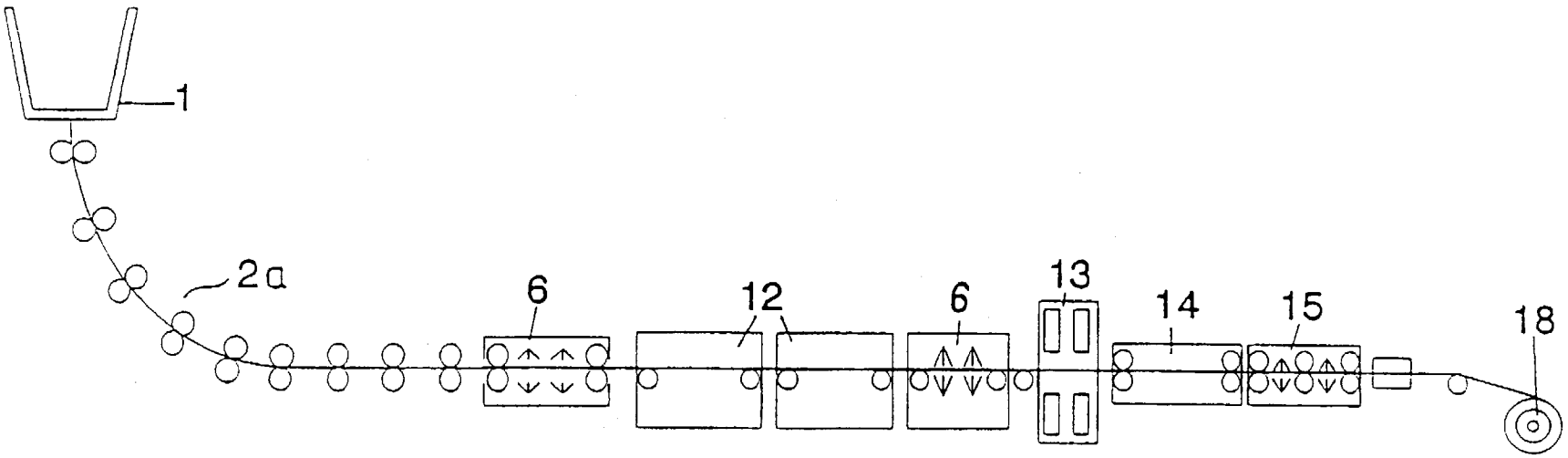

A further advantageous design for the plant according to the invention is to include a strip casting plant **2*a*, as shown in FIG. 7, to cast discrete strips to the desired final thickness and then cool it in a cooling plant 6. This strip is then fed directly to the annealing furnace 12, pushed through it and after going through a further cooling plant, brought to the mechanical de-scaling plant 13 and chemical de-scaling plant 14, until it reaches the recoiler 18 or transverse shears after going through the rinsing plant 15**.

Figure 8:
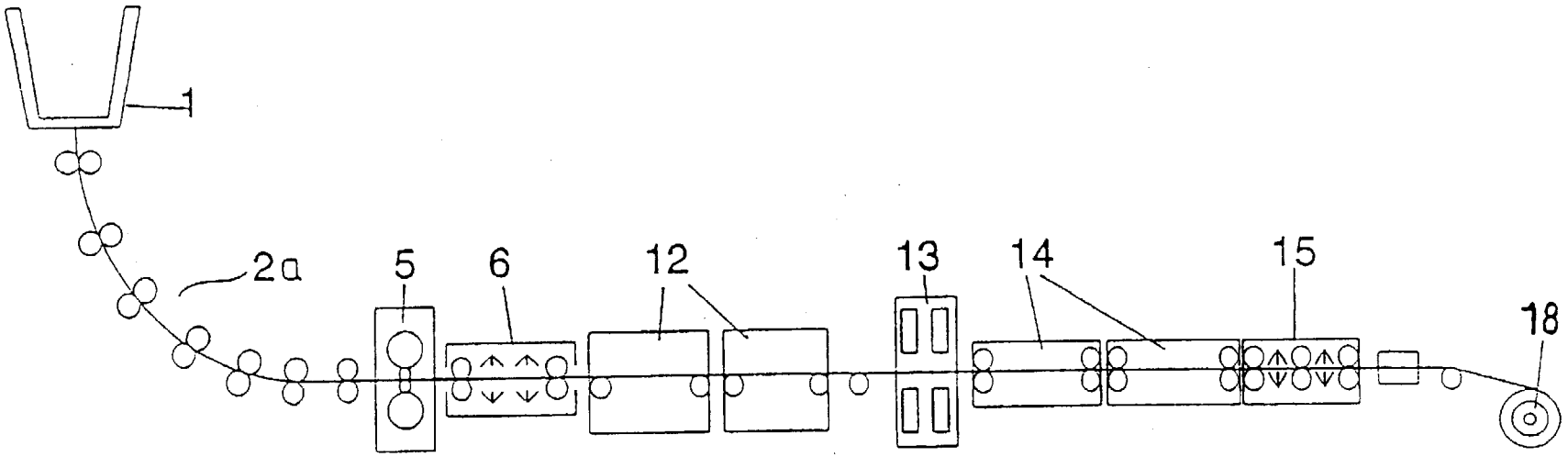

According to the variant of the plant illustrated in FIG. 8, the strip coming out of the strip casting plant **2*a* is hot-rolled first of all to the desired final thickness and then goes through the process stages and plants described in the previous paragraph, with the exception that de-scaling takes place directly after annealing. It can be appreciated from inspection of FIGS. 7 and 8, that in these embodiments, the strip remains in a flat condition, from the casting line 2A to the point of pushing through the heat treatment system 12**.

WORKING EXAMPLES

Example 1

In a test plant a stainless steel strip of grade AISI 304 was cast with dimensions 350 mm wide and 10 mm thick, cooled to a strip temperature of 60° C. and then de-scaled in a chemical pickling plant. The first part of the strip was cut into 1.5 m long plates using transverse shears and the remainder was coiled on a recoiler. The technological characteristics of the stainless steel strip showed the same properties as strip produced using conventional methods.

Example 2

On the same test plant a stainless steel strip of grade AISI 304 was cast with dimensions 350 mm wide and 13 mm thick, cooled a little and then rolled directly in a hot-rolling mill to a final thickness of 5 mm. After the rolled strip was cooled to 45° C., the stainless steel strip was pushed directly through a mechanical and chemical de-scaling plant, pickled, rinsed and dried. The strip was coiled for the first time after being dried. The technological characteristics of the stainless steel strip showed the same properties as strip produced using conventional methods.

Example 3

A stainless steel strip of grade AISI 316 was cast with dimensions 320 mm wide and 8 mm thick, cooled to room temperature and would into a coil. After several days in storage, this strip was heated to 1100°–1300° C. using an inductively heated furnace in a separate, continuous annealing and pickling line, then cooled with air and water to approximately 50° C., de-scaled mechanically and chemically, then recoiled again after rinsing and drying.

Example 4

A stainless steel strip of grade AISI 430 with dimensions 350 mm wide and 15 mm thick was cast, hot-rolled immediately thereafter to a strip thickness of 7 mm, then cooled to room temperature and coiled. After a storage period of several days, this stainless steel strip was annealed again in a separate, continuous-operation annealing and pickling line, then de-scaled mechanically and chemically, and recoiled after rinsing with water and drying.

Example 5

A further stainless steel strip of grade AISI 430 was cast with the same dimensions as in the preceding example, skin-passed and cooled. This strip, however, was not coiled, but pushed into an inductive annealing plant, where the strip was heated again, then cooled and pushed directly to a de-scaling plant, where the scale that had formed on the surface was removed. Only then was the stainless steel strip coiled for the first time.

In all of the tests in examples 1 to 5, no negative effect due to the treatment method was noted on the desired technological properties of the strip.

Example 6

A stainless steel strip of quality AISI 304 produced using the conventional process was divided after hot-rolling from a total width of 1450 mm into a strip 300 mm wide and a second strip 1150 mm wide.

The second strip was annealed in a conventional process in a continuous-operation annealing and pickling plant, subjected to mechanical and chemical de-scaling and then recoiled. The narrow strip was annealed in a batch-operation push annealing and pickling plant with an inductively heated furnace, then also de-scaled mechanically and chemically before recoiling. In a comparison of technological properties, no difference could be found between the two differently treated strips.

Example 7

A stainless steel strip of grade AISI 316 produced using the conventional process was divided after hot-rolling from a total width of 1350 mm into a strip 350 mm wide and a second strip 1000 mm wide. While the broader strip was annealed in a continuous-operation annealing and pickling plant, de-scaled mechanically and chemically, then recoiled, the narrower strip went through a batch-type push annealing and pickling plant. The strip was annealed in the inductive annealing furnace, immediately subjected to mechanical and chemical de-scaling, and then recoiled, but again, no difference could be found between the two strips.

We claim:

1. Process for production of stainless steel strips in which cast steel material in the form of a continuous strip having a leading end and a tail end is coiled onto a roll after it is cast into the strip, uncoiled from the roll, heat treated in a heat treatment system having at least one stage and de-scaled in a de-scaling system having at least one stage, wherein the improvement comprises:

discontinuously uncoiling the strip from the roll, said step of uncoiling commencing prior to heat treating and de-scaling, pushing the strip through the heat treatment system and through the de-scaling system until the leading end of the strip comes out of the de-scaling system, and pulling the strip through the the heat treating system and the de-scaling system by means which engage the strip after the leading end of the strip comes out of the de-scaling system.

2. Process for production of discrete stainless steel strips wherein the strips are not welded together to form a continuous strip during said process, said process comprising:

discontinuously casting stainless steel strips in batches to form discrete strips each having a leading end and a tail end, cooling each discrete strip subsequent to said step of casting, pushing each discrete strip through a heat treatment system and through a de-scaling system until the leading end of each discrete strip comes out of the de-scaling system, and pulling each discrete strip through the heat treatment system and the de-scaling system by means which engage each discrete strip after the leading end of each discrete strip comes out of the de-scaling system.

3. Process according to claim 2, wherein said process further comprises hot-rolling each discrete strip subsequent to said step of casting and prior to said step of cooling, said step of pushing further comprises pushing each strip through a de-scaling system subsequent to pushing each strip through the heat treatment system without intermediate storage, and wherein said step of pulling further comprises pulling each strip through the de-scaling system subsequent to pulling each strip through the heat treatment system without intermediate storage.

4. Process according to claim 2, further comprising coiling each discrete strip on a coiling device after the leading end of each strip comes out of the de-scaling system.

5. Process according to claim 4, wherein said step of pulling further comprises pulling each strip through the heat treatment and de-scaling systems using the coiling device.

6. Process according to claim 2, further comprising cutting each discrete strip into plates after each strip leaves the de-scaling system.

7. Process according to claim 4, further comprising smoothing each discrete strip prior to said step of coiling.

8. Process according to claim 2, wherein said step of de-scaling comprises mechanically de-scaling each discrete strip and chemical pickling each discrete strip in an aqueous medium immediately after said step of mechanical de-scaling.

9. Process according to claim 8 wherein said step of chemically pickling comprises contacting each discrete strip with an acid selected from the group consisting of nitric acid, sulphuric acid, hydrochloric acid, hydrofluoric acid, or a mixture of at least two of these acids and/or aqueous solutions of one or more salts of these acids with the metals contained in the material.

10. Process according to claim 9, further comprising electrolytically treating each discrete strip prior to said step of chemically pickling.

11. Process according to claim 10, wherein said step of electrolytically treating comprises alternately subjecting each discrete strip to anodic and cathodic poling.

12. Process according to claim 2, wherein said step of pushing each discrete strip through a heat treatment system comprises pushing each discrete strip through an inductively heated annealing furnace and wherein said step of pulling each discrete strip through a heat treatment system comprises pulling each discrete strip through an inductively heated annealing furnace.

13. A plant for the production of discrete strips from raw stainless steel material, comprising:

a casting line for casting the raw material into long continuous strips of steel each having a leading end and a tail end, first means for cooling the cast strips, a push-type heat treatment system, means for discontinuously introducing the cooled strips into said push-type heat treatment system, second means for cooling the strips after heat treatment, and a push-type de-scaling system immediately after the second means for cooling.

14. A plant for production of discrete stainless steel strips from raw stainless steel material, comprising:

a casting line for casting the raw material into discrete strips each having a leading end and a tail end;

a hot rolling mill for rolling the discrete strips, means for cooling the rolled discrete strips, a push-type heat treatment system, means for introducing the cooled discrete strips into the push-type heat treatment system, and a push-type de-scaling system immediately after the heat treatment system.

15. Plant according to claim 14, wherein the heat treatment system includes an inductive annealing device.

16. Plant according to claim 13, wherein a driven coiling device is provided after the de-scaling system to grip the leading end of each of the strips coming out of the de-scaling system.

17. Plant according to claim 14, wherein a set of transverse shears is included after the de-scaling system.

18. Plant according to claim 17, wherein a skin-pass mill is included a between the de-scaling system and the coiling device.

19. Plant according to claim 14, wherein the de-scaling system has at least one pickling section with at least one tank to hold aqueous pickling media.

20. Plant according to claim 19, wherein at least one of the tanks contains electrodes of different polarity.

21. Plant according to claim 19, wherein at least one washing and brushing machine is provided between at least two tanks.

22. Plant according to claim 19, wherein a rinsing section with abrasive brushes, is included after the pickling section.

23. Process according to claim 1, wherein said step of discontinuously uncoiling the strip continues during said step of pushing the strip through said heat treatment system.

24. Process according to claim 23, further comprising hot-rolling the strip prior to coiling the strip on a roll.

25. Process according to claim 2, further comprising maintaining each discrete strip in a planar form from said step of casting to said step of pushing each discrete strip through the heat treatment system.

26. Process according to claim 25, further comprising the step of hot-rolling each discrete strip prior to said step of pushing each discrete strip through the heat treatment system.

27. Process according to claim 1, further comprising coiling the strip material on a coiling device after the leading end of each strip comes out of the de-scaling system.

28. Process according to claim 27, wherein said step of pulling further comprises pulling the material through the heat treatment and de-scaling systems using the coiling device.

29. Process according to claim 1, wherein said step of pushing each strip through a heat treatment system further comprises pushing each strip through an inductively heated annealing furnace and wherein said step of pulling each strip through a heat treatment system further comprises pulling each strip through an inductively heated annealing furnace.

30. Process according to claim 4, wherein said step of coiling comprises coiling each discrete strip on a recoiler.

31. Process according to claim 7, wherein said step of smoothing comprises smoothing each discrete strip on a skin-pass system prior to said step of cooling.

32. Plant according to claim 13, wherein the heat treatment system includes an inductive annealing device.

* * * * *